US008926893B2

(12) United States Patent
Boisdequin et al.

(10) Patent No.: US 8,926,893 B2
(45) Date of Patent: Jan. 6, 2015

(54) CASTING SHROUD, MANIPULATION DEVICE FOR THIS SHROUD, AND DEVICE FOR DRIVING A VALVE

(75) Inventors: Vincent Boisdequin, Naast (BE); Mariano Collura, Strepy-Bracquegnies (BE); Jeffrey Butts, Veedersburg, IN (US)

(73) Assignee: Vesuvius Group S.A., Ghlin (BE)

( * ) Notice: Subject to any disclaimer, the term of this patent is extended or adjusted under 35 U.S.C. 154(b) by 394 days.

(21) Appl. No.: 13/130,460

(22) PCT Filed: Nov. 19, 2009

(86) PCT No.: PCT/EP2009/008244

§ 371 (c)(1),
(2), (4) Date: Jun. 20, 2011

(87) PCT Pub. No.: WO2010/057640

PCT Pub. Date: May 27, 2010

(65) Prior Publication Data

US 2011/0278331 A1 Nov. 17, 2011

(30) Foreign Application Priority Data

Nov. 20, 2008 (EP) ..... 08169518
Jun. 29, 2009 (EP) ..... 09008451

(51) Int. Cl.
*B22D 41/12* (2006.01)
*B22D 41/50* (2006.01)
*B22D 11/106* (2006.01)

(52) U.S. Cl.
CPC ..... *B22D 41/50* (2013.01); *B22D 11/106* (2013.01)
USPC ..... 266/236; 222/607

(58) Field of Classification Search
USPC ..... 266/287, 236; 222/594, 606, 607
See application file for complete search history.

(56) References Cited

U.S. PATENT DOCUMENTS

| | | | | |
|---|---|---|---|---|
| 5,645,120 | A * | 7/1997 | Tsuyuguchi et al. | 222/594 |
| 5,984,153 | A | 11/1999 | Richard | |
| 7,628,952 | B2 * | 12/2009 | Klimas | 266/45 |
| 8,215,375 | B2 | 7/2012 | Ebner et al. | |
| 2008/0314938 | A1 | 12/2008 | Ebner et al. | |
| 2011/0227267 | A1 * | 9/2011 | Delsine | 269/55 |
| 2011/0248055 | A1 * | 10/2011 | Collura | 222/590 |

FOREIGN PATENT DOCUMENTS

| | | | |
|---|---|---|---|
| EP | 0577909 | A1 | 1/1994 |
| FR | 2694711 | A1 | 2/1994 |
| JP | 57115968 | A | 7/1982 |
| JP | 09-201657 | | 8/1997 |
| JP | 2003-117639 | | 4/2003 |
| KR | 20040021971 | A | 3/2004 |
| WO | 2007057061 | A1 | 5/2007 |

* cited by examiner

*Primary Examiner* — Scott Kastler
(74) *Attorney, Agent, or Firm* — Thomas Clinton; Donald M. Satina

(57) ABSTRACT

A manipulation device for a shroud for casting liquid metal comprises holding means for the shroud, downstream of a metal flow control valve, this valve being able to assume an open configuration and a closed configuration under the action of drive means. The manipulation device comprises fixing means affixed to the drive means for the valve. A ladle shroud for the flow of liquid metal from a casting ladle to a metal tundish has a longitudinal axis and comprises a shroud gripping head at one end. The gripping head is fusiform.

9 Claims, 9 Drawing Sheets

CASTING SHROUD, MANIPULATION DEVICE FOR THIS SHROUD, AND DEVICE FOR DRIVING A VALVE

BACKGROUND OF THE INVENTION (1) Field of the Invention

The present invention relates to the technical field of the continuous casting of liquid metal, and in particular it relates to a shroud designed to avoid the reoxidation of said metal as it is transferred from an upper metallurgical vessel to a lower metallurgical vessel, and also to a manipulation device for such a shroud.

(2) Description of the Related Art

In the following description, reference will be made more particularly to such a shroud used in the casting of steel between a casting ladle and a tundish, without this being interpreted as a limitation of the present invention.

There is known in the prior art an installation for casting liquid metal, in particular liquid steel, making it possible to transfer the liquid metal from a casting ladle to a tundish, intended to distribute the liquid metal into casting moulds. For the transfer of liquid from the ladle to the tundish, use is generally made of a cylindrical shroud, referred to as a ladle shroud, which is kept pressed against a flow control valve arranged in the bottom wall of the casting ladle.

The flow control valve, referred to as a "sliding gate valve", is equipped with two superposed plates sliding one with respect to the other so that the valve can assume a closed configuration, during which the casting ladle can be displaced, and an open configuration which allows the liquid to pass so as to be transferred into the tundish. The movement of the valve into the closed configuration or into the open configuration is brought about by drive means, often in the form of a hydraulic jack. In order that they are arranged as close to the valve as possible, the drive means are attached, at the moment when the ladle arrives close to the tundish, to the casting ladle or directly to the valve.

Furthermore, when the casting ladle is brought above the tundish, the ladle shroud is also moved below the valve, holding it against the lower plate or a nozzle, such as a collector nozzle, extending the latter. The operation of holding the ladle shroud against the valve can be performed manually or automatically, with a manipulation device arranged on the floor of the installation.

BRIEF SUMMARY OF THE PRESENT INVENTION

The object of the present invention is in particular to provide a manipulation device for the shroud, which makes it possible to hold the shroud as close to the flow control valve as possible, while limiting the number of operations to be performed during the casting process.

To this end, the invention relates to a manipulation device for a shroud for casting liquid metal, comprising holding means for the shroud, downstream of a flow control valve for the metal, this valve being able to assume an open configuration and a closed configuration under the action of drive means, characterised in that the manipulation device comprises fixing means to the drive means for the valve.

It is therefore proposed to arrange the shroud manipulation device not on the floor of the installation but rather directly on the drive means for the flow control valve. Thus, since the drive means are arranged on the flow control valve, or in close proximity thereto, the manipulation device for the shroud is located as close as possible to the surface of the valve against which the shroud must be pressed, or as close as possible to the casting nozzle arranged on the valve.

Furthermore, by assembling the manipulation device for the shroud on the drive means, there is a unique assembly for attachment to the casting ladle when the latter is located close to the tundish. Thereby, in one single operation, both the drive means and the manipulation device for the shroud are assembled on the casting ladle.

It will be noted that the flow control valve is preferably a linear valve, but could be a rotary valve. This valve is for example a sliding gate valve. It will also be noted that the holding means for the shroud comprise for example an arm for holding the shroud. The drive device may additionally comprise one or more of the following features:

- The fixing means are arranged so that the manipulation device follows the movement imposed on the valve by the drive means. In other words, the movement of the manipulation device is slaved to the movement of the drive means for the valve, and therefore to the movement of the valve, more precisely to the movement of the casting orifice of the valve, it being possible for this casting orifice to be borne by a casting nozzle associated with one plate of the valve. As a result, when the casting orifice is moved away from the casting channel, then by an identical movement the shroud is moved away from the casting channel. It is thus not necessary to provide a holding device for the ladle shroud which is capable of following continuously and independently the movements of the valve. Such a device requires indeed a certain complexity.

Furthermore, the same drive means are used for moving away both the casting orifice and the casting shroud, resulting in a gain in terms of energy and space.

- The device additionally comprises driving means for the holding means for the shroud. Thus, besides the movement imposed by the driving of the valve, there is also provided a dedicated movement of the shroud relative to the valve. For example, the shroud can assume a safety position, or waiting position, in which its upper end is raised in order to avoid receiving splashes of liquid metal (for example in the case of non-natural opening of the valve).
- The driving means for the holding means comprise a rotary motor. This rotary motor, associated with a mechanical form in the shape of a parallelogram, can impose a certain trajectory on the holding means for the shroud, in particular a substantially U-shaped trajectory.
- The driving means for the holding means comprise two hydraulic jacks. For example, it comprises one substantially vertical jack and one substantially horizontal jack, the horizontal jack making it possible to make the holding means telescopic, and consequently to distance them from the high casting temperatures and to adapt the manipulation device to different types of installation.
- The drive means for the valve comprise a hydraulic cylinder and a rod sliding in this cylinder, and the driving means for the holding means are carried by a part surrounding the cylinder and being displaced with the rod. This part surrounding the cylinder has the advantage of making particularly compact the assembly consisting of the manipulation device and the drive means for the valve, which makes it possible to reduce the size of the holding means and therefore the force necessary to displace the latter.
- The holding means for the shroud can assume a casting position and a waiting position, the displacement between these two positions having a substantially U-shaped trajectory. The casting position corresponds for example to a position in which the shroud is fitted onto a casting nozzle provided on the valve. The waiting position can advantageously correspond to a safety position distancing the shroud from the casting channel. Since each of casting and waiting positions is located at the end of the branches of the U, the waiting position makes it possible to arrange the shroud at a certain height when it is withdrawn from the casting orifice, so that it does not risk receiving splashes when it is not in the casting position. Thus, the contact surface of the shroud is not encumbered with residues and the shroud remains operational in order to be pressed against other valves. In particular, when the shroud is in the waiting position, it is possible to carry out a cleaning of the casting channel by injection of oxygen. Advantageously, the holding means can assume a third position for loading the shroud onto the manipulation device. This third position corresponds for example, on the U-shaped trajectory, to the intermediate position situated at the base of the U. Thus, since the holding means are lower than the casting orifice, the size is minimal to allow the loading of the shroud onto the manipulation device, for example with an independent robot.

The device comprises temporarily fixing means for the ladle shroud to the valve, for example to a casting nozzle of the valve, in particular for fixing by means of a bayonet fitting, as described below.

The holding means for the shroud comprise means for gripping the shroud, for example in the shape of a spoon equipped with a slot for receiving the shroud. This spoon has the advantage of carrying the shroud by the bottom, so as to hold it effectively, all the more so if the gripping means are resistant to the high casting temperatures. This spoon shape is particularly suitable if the shroud is equipped with a head, the shape of which allows it to be received in the spoon. According to another example, the gripping means comprise a fork, provided with two recesses, preferably three, for cooperating with corresponding studs formed on the shroud.

The holding means for the shroud comprise means for releasing the shroud and the valve, in particular for releasing the shroud from a casting orifice formed on the valve. These means for releasing the shroud may assume for example the shape of a fork cooperating with the head of the shroud so as to give it a downward movement, and thus to detach it from the casting orifice, for example by withdrawing it from a casting nozzle. Preferably, in such a case, the holding device will be equipped with fingers making it possible to exert a traction in the direction of the bottom along the axis of the shroud in the use position.

With regard to holding the ladle shroud in the manipulation device, there is known in the prior art a mechanical solution in which the ladle shroud of any shape is held in a suitable support which can pivot about an axis by virtue of pivots cooperating with housings arranged on the manipulation device. A shroud in such a support has one degree of freedom (pendular movement in a plane orthogonal to the pivot axis); the manipulator arm can generally pivot about its axis in order to provide an additional degree of freedom. For the known devices, bearing on the floor of the installation, this solution on the one hand requires a great mechanical complexity of the manipulation device which must make it possible to compensate mechanically all the positioning and alignment errors and on the other hand requires a considerable dexterity on the part of the operator of the manipulation device. In addition, during the casting, the force necessary to hold the ladle shroud against the casting ladle is essentially transmitted via the studs. In view of the extreme conditions prevailing in the casting installation, these studs are likely to deform and must be replaced frequently. Furthermore, if it is desired to automate the casting installation, this solution is no longer optimal. This is because the support for the shroud has several degrees of freedom (pendular pivoting about the axis defined by the studs and pivoting about the axis of the holding arm). When the automated manipulation device has to take a new shroud, these degrees of freedom must be controlled. This can be done either by motorising the device or by using a set of stops. In both cases, this involves additional complexity.

There is also known in the prior art a ladle shroud having a lower end of hemispherical shape (see for example JP-A1-57-115968). This hemispherical shape is advantageous when use is made of a manipulation device for the ladle shroud which is arranged on the floor of the installation. This is because, in this case, the position of the ladle with respect to the floor of the installation and therefore with respect to the manipulation device cannot be determined precisely. It is therefore indispensable to allow the shroud sufficient degrees of freedom (in translation with the manipulator arm, and in rotation with of the hemispherical shape of the lower end of the gripping head) so that it can assume a correct alignment on the collector nozzle at the time of fitting. Such freedom is not necessary in the case of a manipulation device as described above.

After having attached the ladle shroud to the valve (for example by fitting it onto the collector nozzle), the casting ladle is lowered and the lower end of the shroud is thus immersed in the bath of steel, so that a vertical thrust (ferrostatic thrust) is exerted on the lower end of the shroud from the bottom upwards. The upper end of the shroud is retained by holding the means for the shroud and the valve so that the ferrostatic thrust cannot cause the shroud to rise along its longitudinal axis tending to incline the latter and to disrupt its alignment with the other portions of the casting channel. In turn, this misalignment is responsible for premature wear on the inside of the ladle shroud, for turbulence in the flow of steel which could cause eddies in the tundish and, in the extreme, for disconnection of the shroud from the collector nozzle or damage to the shroud or to the collector nozzle in the region where they are connected to one another.

On the other hand, it is indispensable to provide the shroud with a certain possibility for alignment so as to compensate the mechanical clearances of the device as a whole and to align it correctly with the collector nozzle at the time of fitting. Thus, a mechanical solution which firmly locks the shroud and keeps it aligned with the collector nozzle throughout the entire casting operation would not be suitable since, on the one hand, it would involve additional means for locking (and unlocking the head of the shroud) which are expensive and complicated to implement, but in addition it would prevent any alignment at the time of connection. In particular, it would be desirable if this shroud can align itself in the necessary angular orientation while keeping the support of the shroud fixed so that the robot can grip the shroud easily.

The invention also relates to a shroud, referred to as a ladle shroud, for the flow of liquid metal from a casting ladle to a metal tundish, the shroud comprising a shroud gripping head.

Therefore, one aim of the present invention is to provide a shroud which is better suited to the device described above.

In this device, the ladle shroud is essentially displaced in a vertical plane defined both by the longitudinal axis of the shroud and the direction of the arm for holding said shroud in the device. It is therefore indispensable to maintain a certain freedom of alignment of the ladle shroud in this plane, whereas it would be desirable to limit the movements in the directions not in this plane.

The present invention thus also relates to a ladle shroud for the flow of liquid metal from a casting ladle to a metal tundish, the shroud having a longitudinal axis and comprising a shroud gripping head at one end. According to the invention, the lower part of this gripping head is fusiform.

By definition, a fusiform or spindle-shaped gripping head therefore comprises, in its lower part, a surface which is a portion of a surface of revolution (the axis of revolution of which moreover corresponds to the main pivot axis of the ladle shroud). The surface of revolution is defined by a succession of concentric circles centred on the axis of revolution. The concentric circles may have the same radius, from one end to the other of the axis of revolution (the spindle will then have the shape of a cylinder) or a radius which is variable (increasing then decreasing) from one end to the other of the axis of revolution (the spindle may have a shape consisting of the juxtaposition, at their large base, of two truncated cones or else a spheroid shape). The curvature of the spindle determines the amplitude of the pivoting about a secondary pivot axis (perpendicular to the main pivot axis and in the main pivot plane).

Thus the gripping head is shaped so as to allow a pivoting of the shroud about a main axis, referred to as the main pivot axis, perpendicular to the longitudinal axis of the shroud, and, optionally, about a secondary axis, referred to as the secondary pivot axis, also perpendicular to the longitudinal axis of the shroud, the main and secondary pivot axes being perpendicular to one another; in this case, advantageously, the two pivot axes are skew. Unlike a gripping head of hemispherical shape which allows any pivoting of the ladle shroud, the fusiform gripping head according to the invention allows the pivoting of the shroud in a main plane (defined by the main pivot axis and the longitudinal axis of the shroud) and, optionally, but in any case to a lesser degree, in a secondary plane (defined by the secondary pivot axis and the longitudinal axis of the shroud) perpendicular to the first.

Such a shape allows a pendular movement of the shroud in a plane perpendicular to the pivot axis and comprising the longitudinal axis of the shroud. Therefore, when such a shroud is used in the device described above, if it is ascertained that this plane coincides with that defined above (comprising the longitudinal axis of the shroud and the direction of the arm for holding the shroud), the shroud carries out a pendular movement in the plane along which it is displaced by the manipulation device. Consequently, this shroud automatically aligns itself with the collector nozzle at the time of connection. It is remarkable that this alignment can be carried out without having to mechanise the support of the shroud.

The ladle shroud may for example have a semicylindrical gripping head or, as indicated above, a gripping head having a shape corresponding to half the juxtaposition by the base of two truncated cones. In these cases, the ladle shroud can pivot only about its main axis.

In certain cases in which the alignment in the plane is likely to be deteriorated, it is also possible to allow—but to a lesser degree—an alignment movement in the plane perpendicular to the main pivot plane and therefore, advantageously, the gripping head of the ladle shroud has a curved spindle shape.

It would also be possible to define the lower part of the gripping head of the shroud by the appearance of its meridians (lines at the intersection of the surface of the lower end of the gripping head and of the plane comprising the main pivot axis). These meridians may be straight (in the very advantageous case of a cylinder), may exhibit a break (in the case of the lower end of the gripping head consisting of two truncated cones juxtaposed by their large base) or may be curved (arcs of an ellipsis, arcs of a circle). In the case of a meridian in the shape of an arc of a circle, the radius of this circle may be equal to the radius of the concentric circles along the main axis, but then it is indispensable that the pivot axes are skew. If these radii are different, it is advantageous that the radius of the arc of a circle is significantly larger than that of the concentric circles (in the extreme, if this radius is infinite, the result is a straight line and therefore the lower part of the gripping head is semicylindrical).

In fact, a system is thus produced which corresponds to a cardan-type suspension but without having the drawbacks of this mechanical solution (deformation of the pivot studs and identity of freedom in the two axes). In addition, this would be a cardan-type suspension in which the pivoting about one axis would be markedly favoured over the other axis.

The holding means for the shroud comprise means for gripping the shroud, for example in the shape of a spoon equipped with a slot for receiving the shroud. This spoon has the advantage of carrying the shroud by the bottom, so as to hold it effectively, all the more so if the gripping means are resistant to the high casting temperatures. However, it is also possible to imagine a solution in which the ladle shroud is simply arranged on a fork and held by pads which prevent it from sliding on the arms of the fork while allowing it to pivot, or else a solution in which the lower end of the gripping head would rest on pads, preferably at least four pads.

The invention also relates to a shroud, referred to as a ladle shroud, for the flow of liquid metal from a casting ladle to a metal tundish, characterised in that the shroud comprises means for temporarily fixing the ladle shroud to a flow control valve.

These temporary fixing means are particularly advantageous. Generally, as explained above, this ladle shroud must be held pressed against the flow control valve throughout the transfer of liquid metal from the casting ladle to the tundish. In order to perform this pressing of the shroud against the valve, the manipulation device for the shroud has in particular the function of exerting a force on the shroud during the casting, which consumes energy. The shroud equipped with the temporary fixing means makes it possible to provide a shroud which requires little energy in order to be held pressed against the flow control valve.

Thus, rather than the manipulation device having to hold the shroud against the valve throughout the entire flow of liquid through the valve, it is proposed to temporarily fix the shroud against the valve. The manipulation device for therefore does not consume energy in order to press the shroud, this pressing being performed by the temporary fixing means. These means are removable and can be activated at the start of casting and deactivated at the end of casting in order to release the shroud from the valve. The temporary fixing means are provided for example on a casting nozzle formed on the valve.

The shroud may additionally comprise one or more of the following features:

The shroud comprises an upper end and the temporary fixing means comprise means for receiving a rotary element, arranged so as to be mounted on this end and to cooperate with the valve, optionally with a casting nozzle formed on the valve. This rotary element may be mounted firstly on the shroud and then on the valve, or firstly on the valve and then on the shroud. Furthermore, it may be mounted in a fixed position relative to the valve and in a rotary manner relative to the shroud, or vice versa.

The shroud additionally comprises means for the angular orientation of the shroud about the vertical axis of the shroud. These means have the advantage of allowing the shroud to assume different possible angular orientations. For example, these orientation means comprise wings distributed uniformly around a circumference of the shroud, optionally spaced apart by 90°. The shroud can thus be picked up by a robot in different angular orientations, and thus can have different angular orientations relative to the casting ladles. As a result, the shroud is not used in a single orientation throughout its entire service life, and therefore it wears evenly around its circumference, resulting in a longer lifespan.

The shroud comprises means for releasing the shroud from a casting orifice, for example a collar formed on the upper end of the shroud which cooperates with fingers provided on the manipulation device. This collar forms a bearing shoulder for the fingers provided on the manipulation device described above. These means also have the advantage of preventing the shroud from rising under the effect of the ferrostatic thrust if the holding device has to be lowered while the lower end of the shroud is still immersed. In one particularly advantageous case, the means for releasing the shroud consist of one or more volumes hollowed out or in relief which are formed in the outer side wall of the shroud at its upper end, which cooperate with one or more fingers or hollows provided on the manipulation device. In this case, besides the two advantages indicated above, the shroud is also held in position in the fork and any horizontal displacement is avoided (while allowing it the possibility of aligning itself). Advantageously, the side walls of the gripping head of the shroud will be provided with two recesses, each comprising side walls and a bottom wall, which can cooperate with fingers mounted on the fork. According to one preferred variant, these fingers are mounted on springs and can therefore be released from the recess either manually or by exerting a sufficient traction on the shroud.

The invention also relates to a drive device for a flow control valve for casting liquid metal.

Generally, as presented above, the drive device for the valve is a hydraulic jack, comprising a cylinder separated into two chambers by a movable piston. This piston is connected to a rigid rod which is connected to one of the gates of the valve, so that the displacement of the piston, under the effect of introducing fluid into one of the chambers, brings about the displacement of the gate.

In the prior art, when the casting ladle arrives close to the tundish, the hydraulic jack is attached to a housing provided on the valve or close to the valve, on the casting ladle. Since the drive device has the outer shape of the cylinder and since the sliding rigid rod extends from one of the bases of the cylinder, the drive device is generally fixed by immobilising the cylinder in the housing. One of the walls of the housing is penetrated by the rigid rod, allowing the latter to slide so as to drive the valve.

Thus, in order to mount the drive device on the casting ladle, it is generally necessary to insert the cylinder into the housing. In order to reduce as far as possible the clearances between the cylinder and the housing, the cylinder is received as tightly as possible in the housing, although mounting by insertion can be relatively difficult to implement.

The present invention aims in particular to propose a drive device mounted in a particularly quick and easy manner on the casting ladle or the flow control valve.

To this end, the invention relates to a drive device for a flow control valve for casting liquid metal, comprising a first piston making it possible to displace the valve between an open configuration and a closed configuration, characterised in that it comprises a second piston for fixing the drive device relative to the valve.

Thus, the second piston having the function of fixing the drive device to the valve (or to the casting ladle carrying the valve), it is possible to attach the drive device regardless of the size of the housing in which it is received. This is because the second piston, being able to be displaced under the effect of a hydraulic pressure, makes it possible to adjust the size of the drive device so as to suppress or reduce the clearances between the housing and the drive device. In other words, the movable second piston makes it possible, according to a first step, to insert the drive device into a housing, while allowing the presence of a clearance, and, in a second step, to compensate the clearance by displacing the second piston, and thus causing the clearance between the drive device and the housing to disappear.

As a result, it is possible to provide a housing that is larger than usual, making it easier to insert the drive device into the housing, while causing the clearance, although very small, that existed in the prior art housings to disappear. By causing the clearance between the drive device and its housing to disappear, any head loss during the travel of the first piston for driving the flow control valve is avoided. In addition, by allowing the clearances during the first step, it is possible to automate easily the mounting of the drive device on the casting ladle.

The drive device may additionally comprise one or more of the following features:

The drive device is intended to be received in a housing secured to the valve, optionally via a casting ladle on which the valve is mounted, the second piston being arranged so as to press against a wall of the housing so as to lock the drive device in the housing by clamping. This locking by clamping ensures that there is no clearance between the cylinder and the housing.

The second piston comprises a piston head and an opposite end, intended and configured to form a wedge between the drive device and the wall of the housing after the displacement of the second piston.

The drive device comprises two hydraulic chambers, one of the chambers being delimited on the one hand by the first hydraulic piston and on the other hand by the second hydraulic piston. Thus, the second piston makes it possible to fix the drive device on the ladle or the valve, without requiring a complex structure of the drive device. In particular, the cylinder can comprise just two hydraulic chambers, and it is not necessary to add a third or a fourth chamber for controlling the second piston, since the same hydraulic chamber is used for manoeuvring the first piston and the second piston.

The second piston is penetrated by a rigid rod controlled by the first piston.

An elastic washer is arranged around the rod below the head of the first piston, so as to distance the latter and allow the injection of the hydraulic fluid, thus avoiding any risk of blockage.

The invention also relates to the assembly comprising or consisting of a manipulation device and/or of a drive device and/or of a ladle shroud as described above. Thus, all the functionalities described above concerning the ladle shroud, the manipulation device and the drive device can be present independently, in communication or in combination.

BRIEF DESCRIPTION OF THE SEVERAL VIRES OF THE DRAWINGS

The invention will be better understood on reading the following description, given purely by way of example and with reference to the drawings, in which:

FIGS. 1*a* to 1*c* are views illustrating a casting installation comprising a manipulation device according to one embodiment, assuming respectively a casting position, a loading position and a safety position;

FIG. 2 is a more detailed view of the manipulation device of FIG. 1*a;*

FIGS. 2*a* to 2*d* are views in cross-section illustrating the kinematics of the device of FIG. 2;

FIG. 3 is a view of a manipulation device according to a second embodiment;

FIGS. 3*a* to 3*c* are views in cross-section illustrating the kinematics of the device of FIG. 3;

FIG. 4 is a view in cross-section and in perspective of a manipulation device according to a third embodiment;

FIGS. 4*a* to 4*d* are views in cross-section illustrating the kinematics of the device of FIG. 4;

FIG. 5*a* is a view illustrating the holding, by a manipulation device, of a ladle shroud according to one embodiment;

FIG. 5*b* is a view in cross-section of a ladle shroud similar to that of FIG. 5*a;*

FIG. 6 is a view in cross-section and in perspective of a device for driving a flow control valve according to one embodiment;

FIGS. 6*a* to 6*d* are views in cross-section illustrating the operation of the device of FIG. 6;

FIGS. 7*b* and 7*d* are views illustrating a ladle shroud according to another embodiment;

FIGS. 7*a* and 7*c* are views in cross-section of FIGS. 7*b* and 7*d;*

DETAILED DESCRIPTION OF THE INVENTION

Figure 1A:
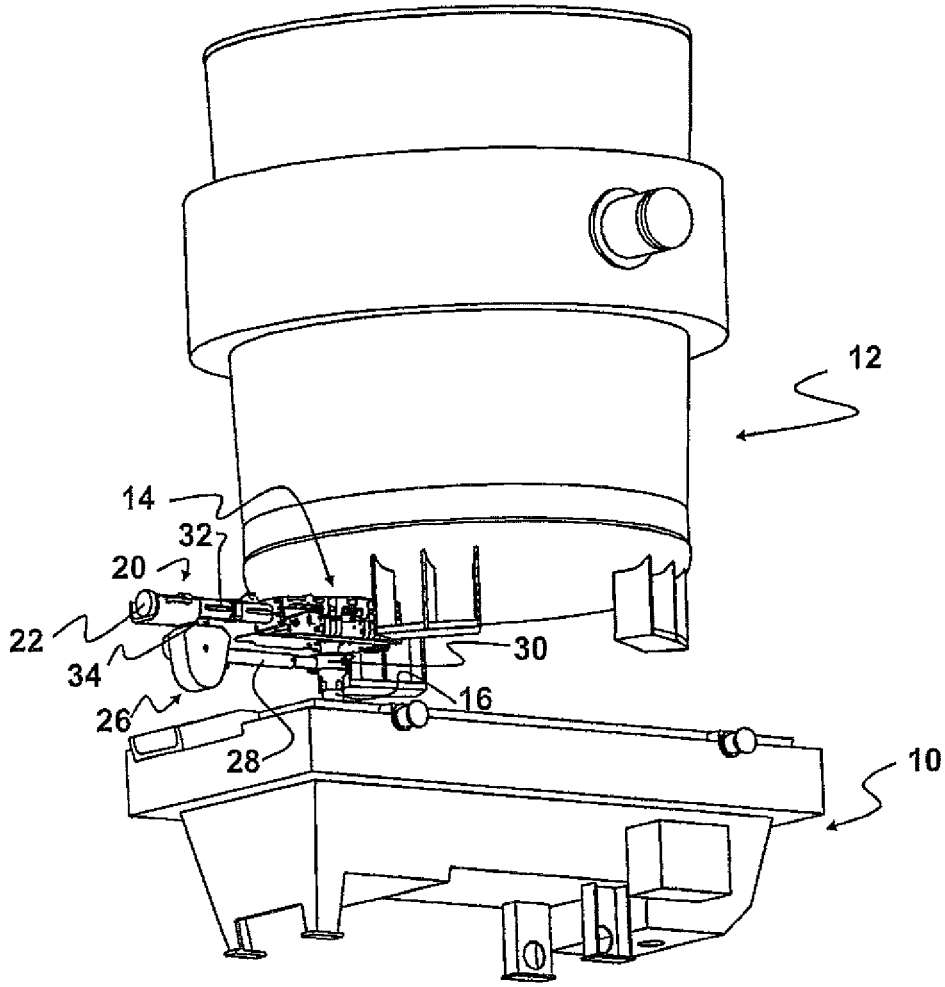

As shown in FIG. 1*a*, a casting installation comprises a tundish 10 intended to distribute liquid metal to casting moulds. This tundish 10 is supplied with liquid metal by casting ladles 12, which are displaceable above the tundish for this transfer. The ladle 12 is equipped with a valve 14 for regulating the flow of metal. This valve 14 consists here of a linear valve, a sliding gate valve.

Figure 1B:
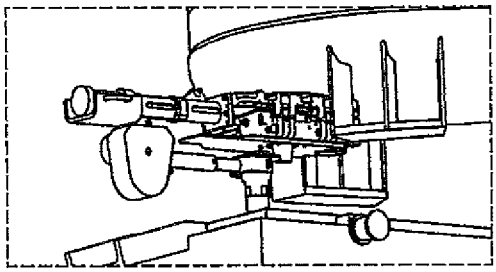

The transfer of liquid metal between this valve 14 and the tundish 10 is carried out by means of a ladle shroud 16, intended to be pressed against a casting orifice of the valve 14, more precisely against a collector nozzle 18 of this valve, visible in FIG. 1*b*.

The gate valve 14 is controlled by drive means 20 which allow the valve to assume an open configuration, in which the two gates are superposed and the casting channel is open, the casting orifice 18 allowing the passage of liquid, and a closed configuration, in which the gates of the valve 14 are offset, preventing the flow of metal.

Figure 2:
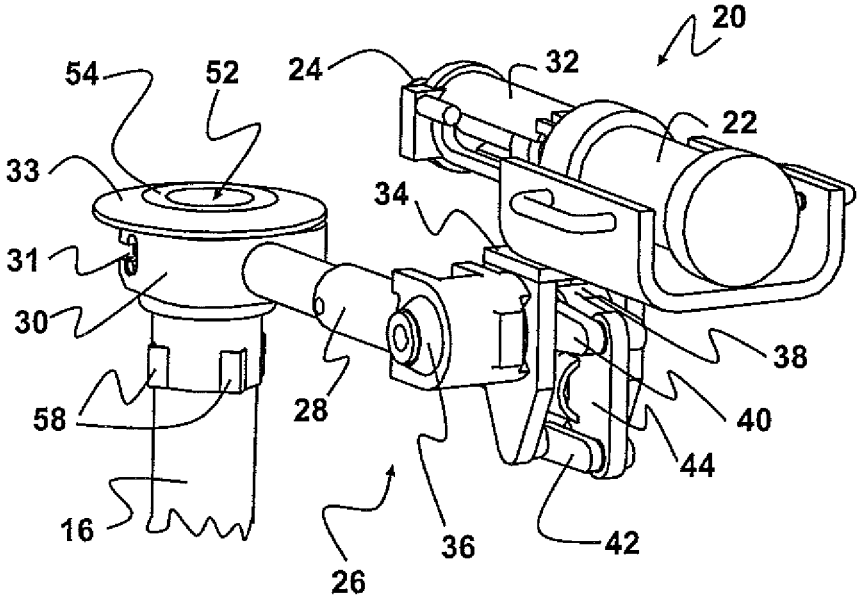
Figure 2A:
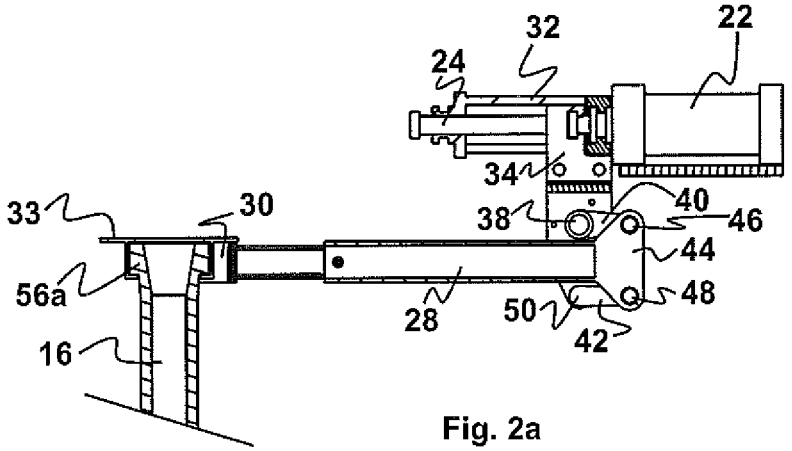
Figure 2B:
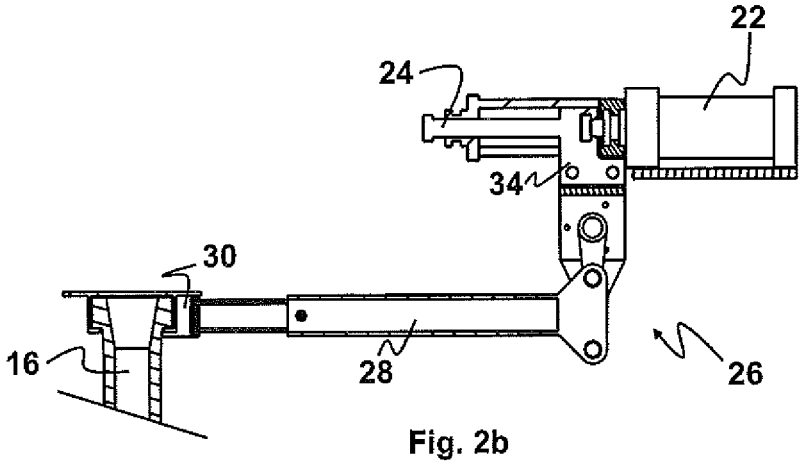

The drive means 20 comprise a hydraulic jack, comprising a cylinder 22 and a rigid rod 24, visible in FIG. 2. The rod 24 is connected on the one hand to a piston sliding in the interior of the cylinder 22, and on the other hand to the valve 14, so as to control the displacement of one of the gates thereof.

The casting installation additionally comprises a device 26 for manipulating ladle shrouds such as the shroud 16. This device 26 comprises holding means for the shroud, here comprising an arm 28 extended by gripping means composed of a fork. In this example, the fork 30 comprises two notches 31, each defining a mushroom-shaped recess. These notches 31 form means for gripping the shroud 16, as described below. Advantageously, the device also comprises a protective lid 33 pierced with an opening which exposes the casting channel, in order to protect the device from any splashes of steel.

The manipulation device 26 additionally comprises fixing means 32, 34 to the drive means 20 for the valve 14. More precisely, these fixing means comprise, in the example of FIGS. 1*a* to 2*d,* a cylinder 32, inside which a support 34 is mounted such that it can move by being displaced with the rigid rod 24. This support 34 is arranged so that the manipulation device 26 follows the movement imposed by the drive means 20. In other words, the movement of the device 26 is slaved to the movement of the rigid rod 24, sliding with the piston of the cylinder 22 so as to bring about the opening or the closing of the valve.

The manipulation device 26 additionally comprises driving means 36 to 50 for the holding means for the shroud 16. In the embodiment of FIG. 2, the driving means comprise a rotary hydraulic motor 36, driving in rotation an axle 38 which itself drives a first connecting rod 40 and a second connecting rod 42 which are parallel and connected to one another by the end 44 of the holding arm 28. Thus, the means for driving the arm 28 comprise four rotation axles 38, 46, 48, 50 (see FIG. 2*a*) defining the corners of a deformable parallelogram. The different shapes of the parallelogram are shown in FIGS. 2*a* to 2*d*, this deformation being controlled by the motor 36.

Figure 1C:
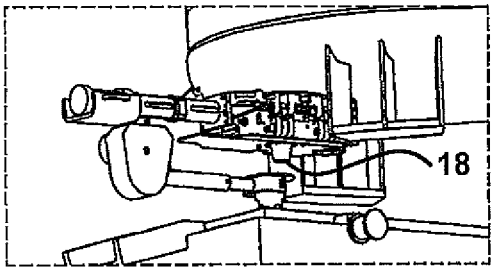

As can be seen in FIGS. 1*a* to 1*c*, the manipulation device 26 can assume a casting position, shown in FIG. 1*a*, in which the shroud 16 is pressed against the valve 14; a loading position, shown in FIG. 1 b, in which the shroud 16 is lowered compared to the casting position and frees up space so as to allow an external robot to load the shroud 16 onto the device 26; and a waiting position, or safety position, visible in FIG. 1*c*, in which the shroud is released from the casting orifice of the valve 14, but at a height that is sufficiently high to avoid splashes that escape from the casting orifice from being able to be deposited on the upper surface of the shroud 16. As can be seen in the figures, the casting, loading and waiting positions define a U-shape in the plane parallel to the height of the installation and to the axis of the jack 22, the casting position (FIG. 1*a*) and waiting position (FIG. 1*c*) defining the upper ends of the two branches of the U and the loading position (FIG. 1*b*) being located in the lower part of the U.

The ladle shroud 16 is a cylindrical shroud of revolution, defining a flow channel 52 and equipped, at its upper end 54, with a gripping head 56*a*. The gripping head 56*a* comprises means for gripping by the holding means 28, 30, comprising in this example studs which are designed to be introduced into the notches 31, being retained in the notches by gravity. Two studs may be provided, but it is preferable to provide three studs so as to be able to control the orientation of the shroud 16 by the holding means. Alternatively, the gripping head of the shroud may be equipped with notches which cooperate with fingers 63 carried by the fork 30.

The shroud 16 additionally comprises means for orienting, or adjusting the angular orientation of, the shroud 16 about its vertical axis, shown in FIG. 2.

These orientation means take the form of wings 58 distributed around the circumference of the shroud, spaced apart by 90° in this example, and allowing a robot or the manipulation device to grip the shroud 16 in different orientations over the course of its life.

The mode of operation of the manipulation device 26 will now be described, with the aid of FIGS. 1*a* to 2*d*.

During the casting process, the ladle 12 with the valve 14 installed thereon arrives close to the tundish 10. The drive means 20 are then attached to the valve 14, said means being associated with the manipulation device 26. During this step, the device 26 does not yet carry a shroud and is located in the loading position shown in FIG. 1*b* or alternatively in FIG. 2*b*. A ladle shroud 16 is then attached to the device 26, for example by means of an external robot, by making the studs of this shroud 16 cooperate with the recesses 31. In this loading position of the shroud, the valve 14 is closed and the piston rod 24 is retracted into the cylinder 22.

Figure 2C:
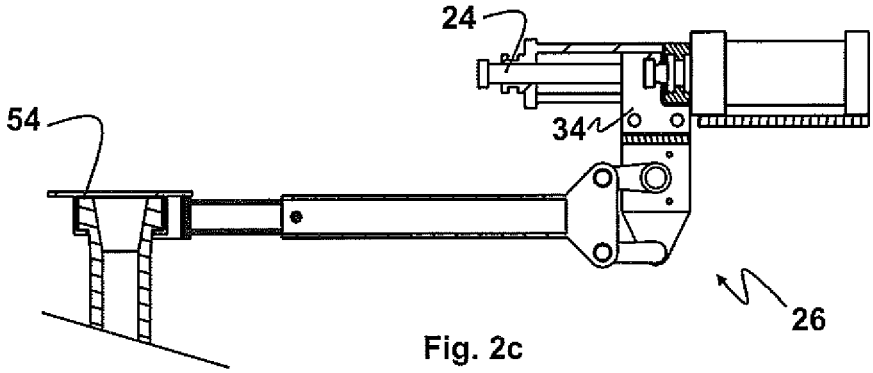
Figure 2D:
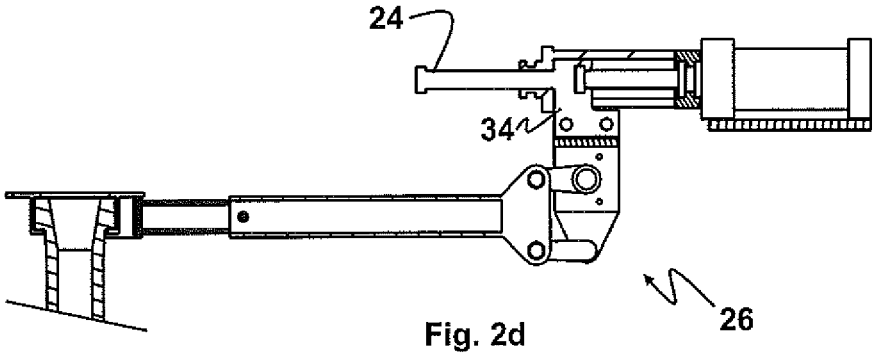

Once the shroud 16 has been loaded onto the device 26, the motor 36 is started so that the arm 28 assumes the casting position, shown in FIG. 2*c*, in which the upper end 54 of the shroud is pressed against the valve 14, optionally by fitting the nozzle 18 onto the casting channel 52. Once the shroud 16 is pressed against the valve 14, the valve can be opened by activating the jack 22, so as to cause the rod 24 to slide and to be extended, thereby driving one of the gates of the valve 14, as shown in FIG. 2*d*. It will be noted that the means can operate inversely, the rod 24 being activated in the other direction in order to open the valve.

As can be seen, the sliding of the rod 24 brings about the sliding of the support 34 and thus of the entire manipulation device 26, the manipulation device 26 being slaved to the movement of the rod 24. Thus the casting nozzle 18, connected to the sliding gate of the valve 14, and the ladle shroud 16 are displaced in one and the same movement.

The valve 14 being open, the liquid metal can flow into the shroud 16, in order to pass into the tundish 10.

Since it is possible for the casting orifice 18 to become clogged, the possibility is provided of cleaning the casting nozzle by injecting oxygen into the casting channel of the ladle 12, so as to burn or melt the residues. To this end, it is possible to release the shroud 16 from the valve 14, placing it into the waiting position illustrated in FIG. 2*a*. More precisely, once the valve 14 has been closed again so as to be in the position of FIG. 2*c*, the motor 36 drives the holding arm 28 so that it assumes the safety position illustrated in FIG. 2*a*. Thus the shroud 16 is released from the casting orifice and is moreover displaced to a height that is sufficiently high to avoid receiving splashes at the time of lancing the casting orifice with oxygen. It will be understood that the trajectory followed by the holding arm 28 in order to pass from the casting position to the safety position is in the shape of a U.

Figure 5A:
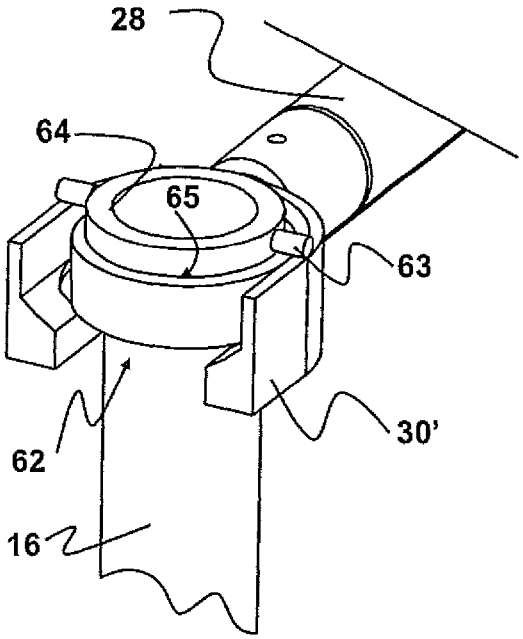
Figure 5B:
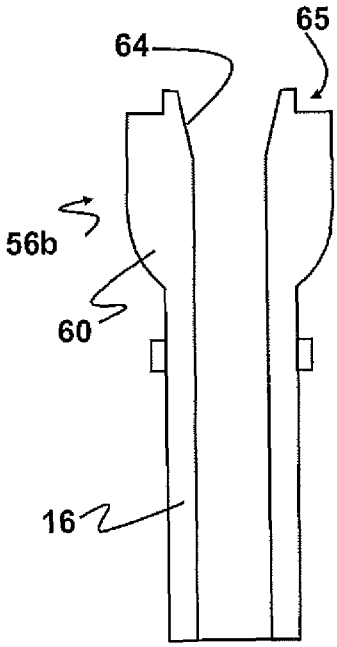

FIGS. 5*a*, 5*b* show a variant embodiment of the device 26 and of the shroud 16 of FIGS. 1*a* to 2*d*. In this variant, the head 56*b* of the ladle shroud 16 has a semi-hemispherical shape 60, and the gripping means arranged on the end of the holding arm 28 have the shape of a spoon 30', equipped with a slot 62 for receiving the shroud 16. Thus the shroud 16 is easier to orient and to hold pressed against the valve 14.

Furthermore, the shroud 16 is provided with means 65 for releasing the shroud 16 from the valve 14. More precisely, the upper end 54 of the shroud 16 comprises means 64 for pressing the shroud against the valve, in this case a shape 64 for attaching the head 56*b* to the casting nozzle 18. The release means 65 comprise a collar, or shoulder, arranged around these attachment means 64, making it possible to form a bearing for releasing the shroud 16 in the downward direction, for example a bearing for a fork gripping the shroud around the shape 64 in order to release said shroud. The release may be carried out for example by means (for example fingers 63) for releasing the shroud which are provided on the means 30'.

According to another embodiment of the shroud, which can be combined with the embodiment of FIGS. 5*a*, 5*b*, means for temporarily fixing the shroud 16 to the valve are provided on the shroud, said means being shown in FIGS. 7*a* to 7*d*. These means make it possible to temporarily fix the shroud 16 to the valve during the casting of liquid, when the valve is open, which reduces the energy used by the manipulation device. In this example, the temporary fixing is a fixing by a bayonet fitting.

The means comprise an element 66 cooperating on the one hand with the valve 14, more precisely with the casting nozzle 18, and on the other hand with the end 54 of the shroud 16. This element 66 is arranged so as to be mounted to rotate on this end 54 and to cooperate with the nozzle 18. More precisely, the element 66 comprises means (for example a rim 68) for cooperating with the head 56*c* of the shroud 16, designed or configured to cooperate with receiving means comprising a rim 72 of the head 56*c*. The element also comprises means 70 for cooperating with the nozzle 18, cooperating by abutment with a rim 74 of the nozzle 18.

The temporary fixing of the shroud 16 to the valve 14 takes place as follows. The element 66 is firstly secured to the valve 14, by making the stops 70, 74 cooperate. Then the shroud 16, equipped with its head 56*c*, is attached in line with the element 66, the head 56*c* being oriented in such a way that the rim 68 is not in line with the rim 72 of the head, and can therefore be inserted into the bottom of the head 56*c*. Once the rim 68 is in the head 56*c*, a rotation of the head 56*c* is carried out, for example through one quarter of a turn, so that the rim 72 of the head covers the rim 68 of the element 66, and thus the shroud 16 is retained by this rim 68. This bayonet fixing can of course be deactivated by carrying out a rotation in the opposite direction to release the rims 68 and 72.

FIGS. 3, 3*a* to 3*c* show a manipulation device according to another embodiment than that of FIGS. 2, 2*a* to 2*d*. However, this device is relatively similar and only the differences will be described below.

This manipulation device 26' is particularly compact since it is not necessary to provide the cylinder 32 of the device of FIG. 2. This is because, in this embodiment, the means for fixing the device 26' to the drive means 20 comprise a part 80 surrounding the cylinder 22 and fixed to the rod 24, so that this part 80 is displaced with the rod when the piston slides in the cylinder 22. Furthermore, the holding arm 28 is taken up at the sides by lateral arms 82, carried on both sides of the part 80. The motor 36' is arranged between these two arms 82.

Figure 3:
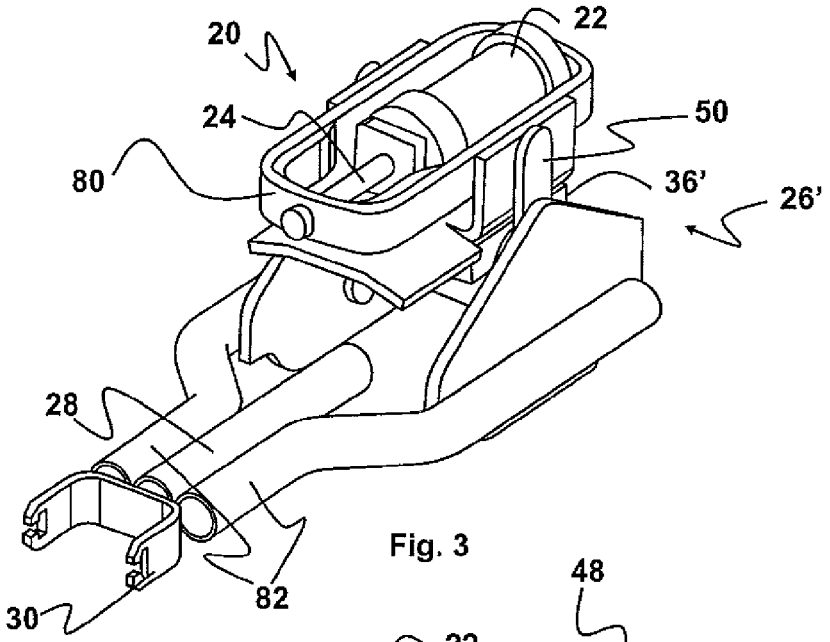
Figure 3A:
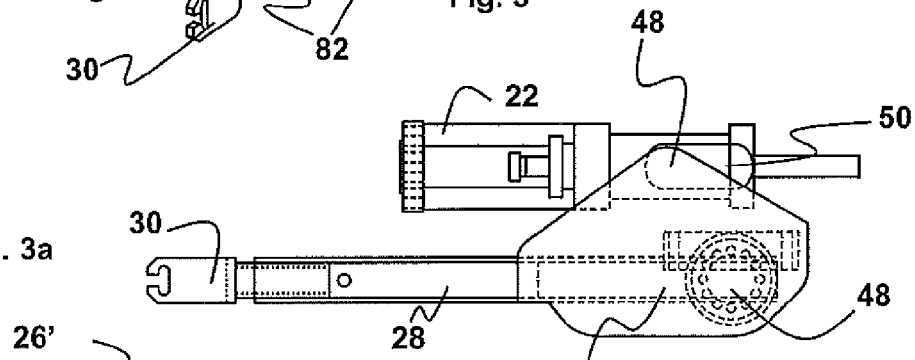
Figure 3B:
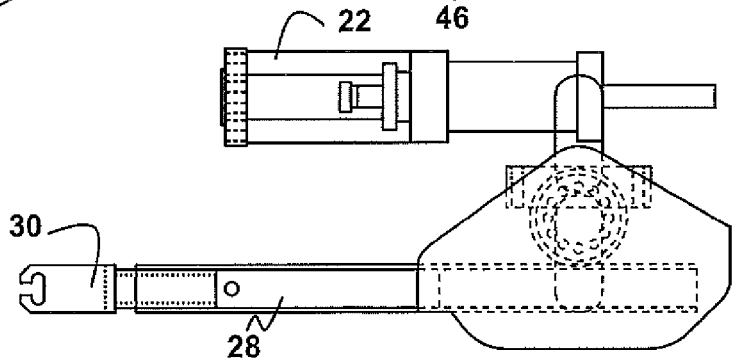
Figure 3C:
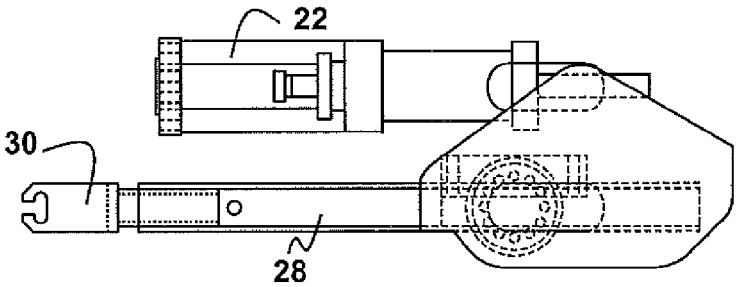

The mode of operation of this embodiment is similar to that of FIG. 2, the axles 38, 48, 46, 50 forming a parallelogram that can be deformed in order to reach the casting, waiting and loading positions defined previously. More precisely, FIG. 3*a* shows the device in the casting position, the valve being closed; FIG. 3*b* shows the device in the loading position, and FIG. 3*c* shows the device in the safety position.

Figure 4:
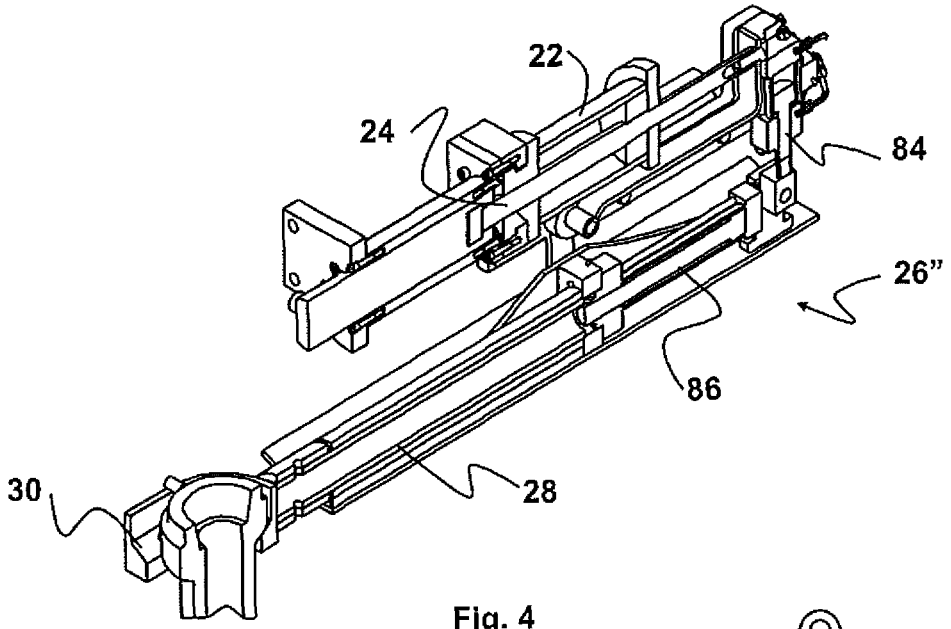

The device of FIG. 4 corresponds to a third embodiment of the manipulation device 26". This device also comprises a part surrounding the cylinder 22 and being displaced with the rod 24. It is therefore also compact. In this device, the means for driving the holding means 28, 30 do not comprise a rotary motor such as the motor 36, but rather two hydraulic jacks 84, 86 which are shown highly schematically in FIG. 4. The hydraulic jack 84 is substantially vertical, and the hydraulic jack 86 is substantially horizontal. In this embodiment, the drive means do not comprise a parallelogram composed of four orientation axles. The movement of the holding means 28 is controlled by the synchronisation of the jacks 84, 86 (by means which are not shown) and by pivot connections 88, 90. More precisely, the vertical jack 84 makes it possible to displace the pivot axle 88 in the vertical direction, and the jack 86 makes it possible to cause the arm 28 to slide telescopically.

Figure 4A:
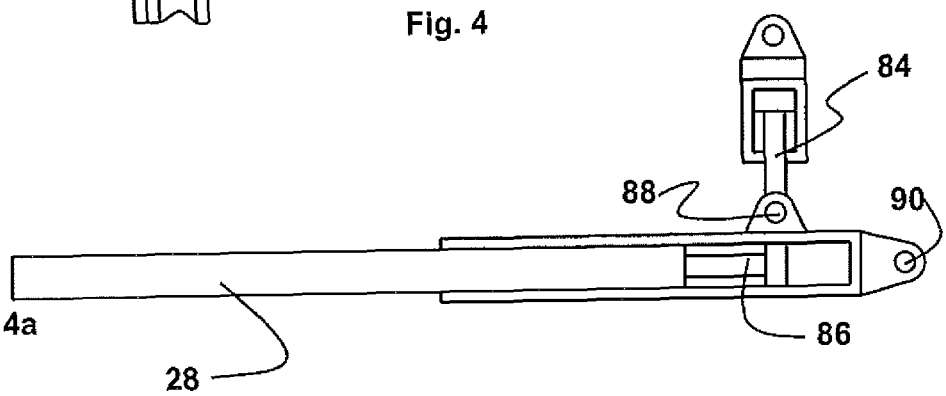
Figure 4B:
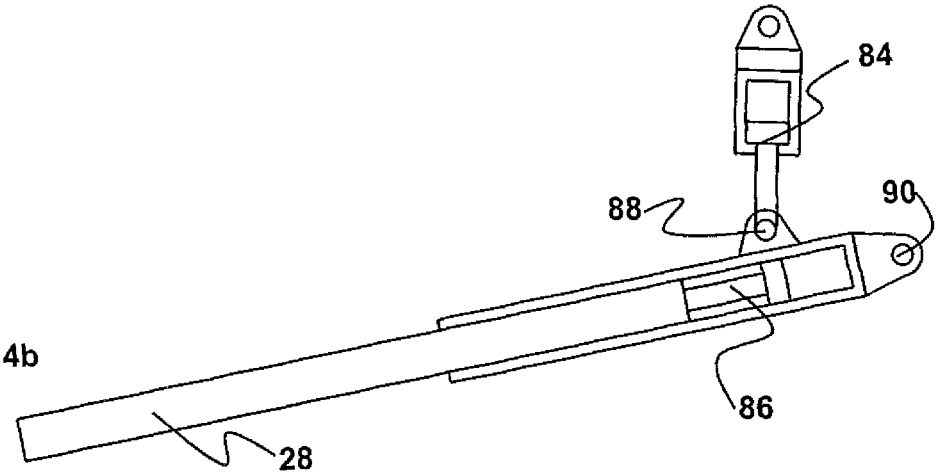
Figure 4C:
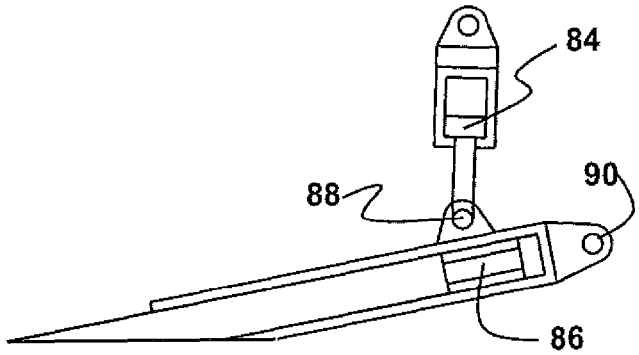
Figure 4D:
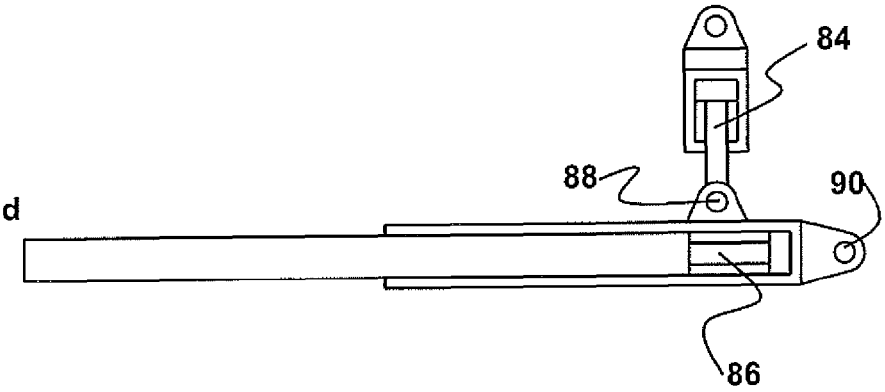

The mode of operation of the device 26" is described in FIGS. 4*a* to 4*d*. In FIG. 4*a*, the device is in the casting position, the arm 28 being extended by virtue of the jack 86. In FIG. 4*b*, the jack 84 pushes on the axle 88 so as to incline the jack 86 and thus lower the end 30 of the arm 28, the device then being in the loading position. In FIG. 4*c*, the device is also in the loading position, but the arm 28 is shortened by sliding in the jack 86. In FIG. 4*d*, the device is in the safety position, the arm 28 being shortened by virtue of the jack 86 and lifted by virtue of the jack 84.

In the same way as for the other embodiments, it can be seen here that the end 30 of the holding arm 28 has a U-shaped trajectory.

FIGS. 6, 6*a* to 6*d* show a drive device 100 for the valve 14. This drive device 100 may be similar to the drive means 20 described above, or may be used in a completely different context.

The device 100 comprises a cylinder 102, equipped with a first piston 104, connected to a rigid rod 106, similar to the rod 24, which controls the valve 14 by virtue of its end 108. The piston 104 delimits, with the cylinder 102, two hydraulic chambers 110, 112 which are visible in FIG. 6*b* and can be supplied by a fluid through supply channels 114, 116.

The drive device 16 is designed to be fixed to a casting ladle 12, more precisely in a housing 118 provided on the casting ladle, or alternatively on the valve 14. In order to carry out this fixing of the device 100 relative to the valve 14, the device 100 comprises a second piston 120, arranged or configured to press against a wall 122 of the housing 118 so as to lock the drive device 100 in the housing 118 by clamping. More precisely, the second piston 120 is designed or configured to form a wedge between the drive device 100, more precisely the cylinder 102, and the wall 122 of the housing 118. The piston 120 and the wall 122 are penetrated by the rod 106 controlled by the piston 104, so as to allow this rod to slide under the effect of the displacement of the first piston 104.

Figure 6A:
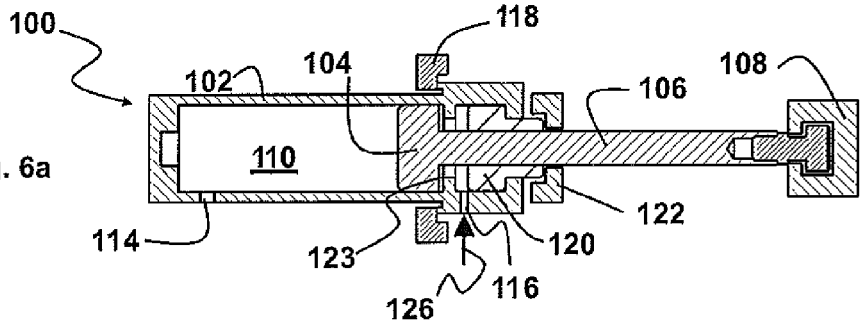
Figure 6D:
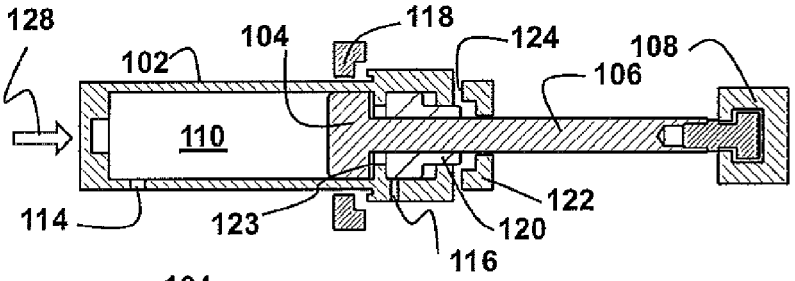
Figure 6B:
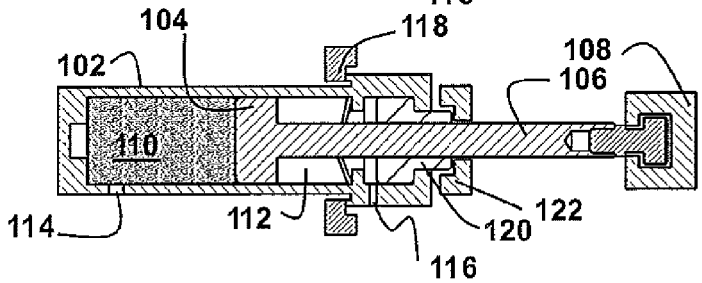

As can be seen in FIG. 6*b*, the chamber 112 is delimited on the one hand by the first piston 104 and on the other hand by the second piston 120.

The mode of operation of the device 100 will now be described. Before being attached to the housing 118, the drive device 16 has substantially the configuration illustrated in FIG. 6*d*. The second piston 120 is in the retracted position in the chamber 112 and protrudes not at all or only very slightly from the cylinder 102, so that the length of the cylinder 102 is relatively small. Since the length of the cylinder 102 is shortened, it is easily possible to insert it into the housing 118, by virtue of a clearance 124. In order to lock the cylinder 102 in the housing 118, fluid is injected into the orifice 116, in the direction of the arrow indicated by reference 126 in FIG. 6*a*. The injection of fluid causes the piston 120 to slide towards the wall 122 so that it is displaced out of the cylinder 102 and bears against the wall 122. Thus, the clearance 124 between the housing 118 and the cylinder 102 disappears, and the device 100 is locked by clamping.

Figure 6C:
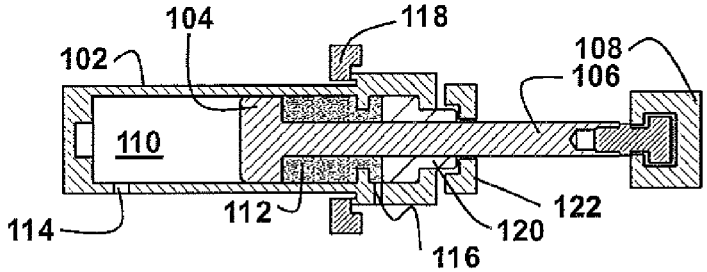
Figure 6:
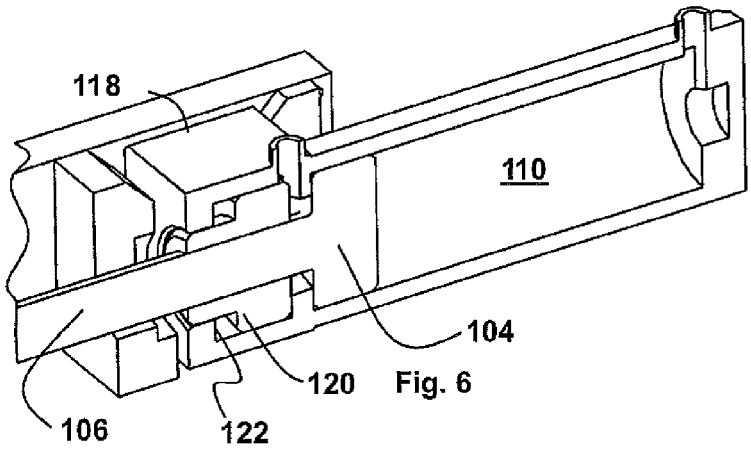
Figure 7A:
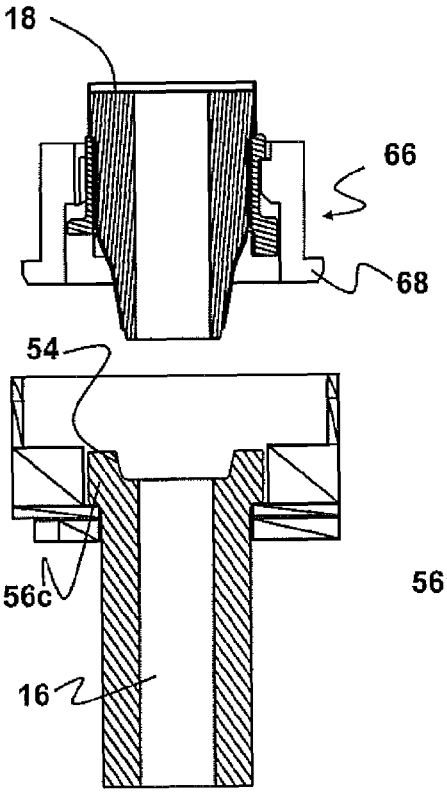
Figure 7B:
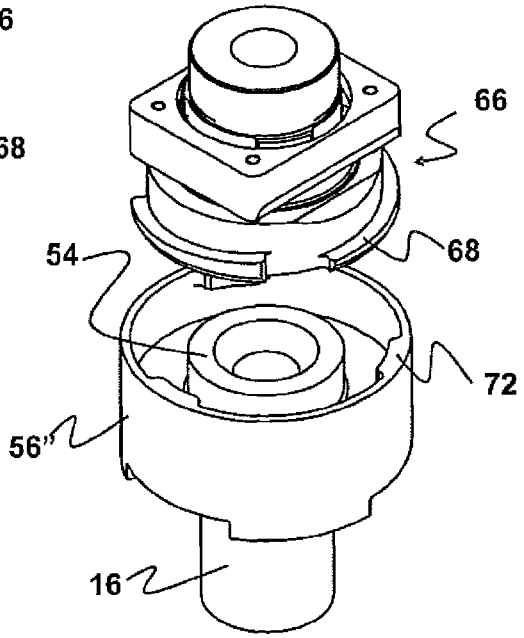
Figure 7C:
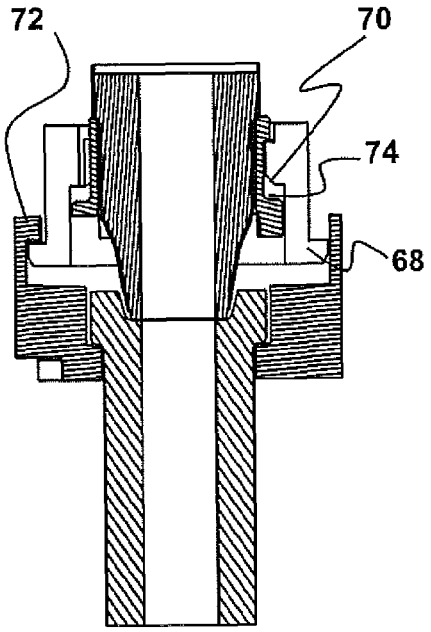
Figure 7D:
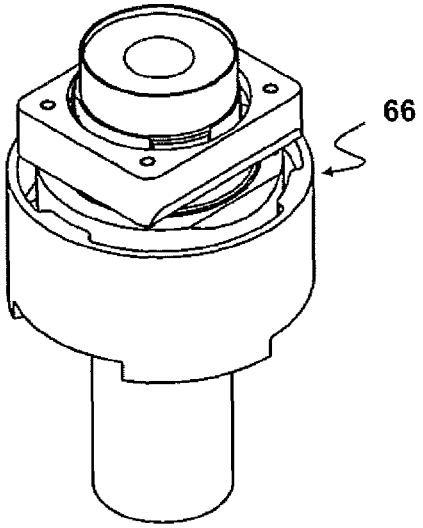
Figure 8:
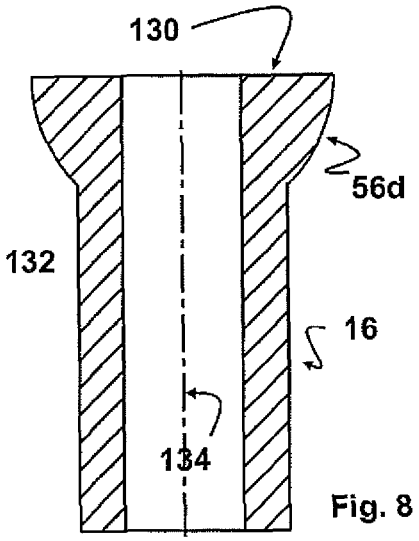
FIG. 8 shows a cross-section along a plane comprising the longitudinal axis of the shroud and the secondary pivot axis of a ladle shroud according to one embodiment.
Figure 9:
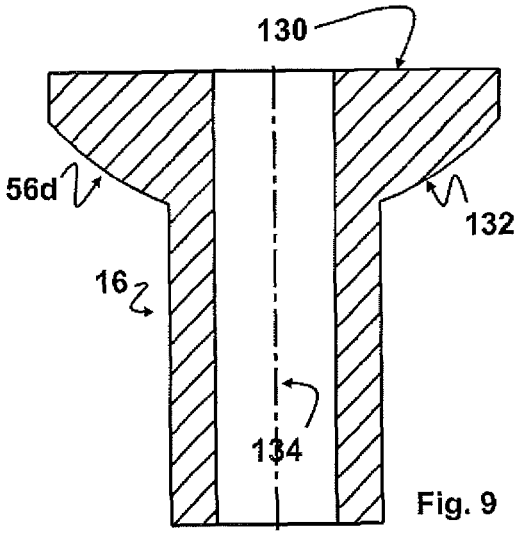
FIG. 9 shows a cross-section along a plane perpendicular to that of FIG. 8 comprising the longitudinal axis of the shroud and the main pivot axis of the ladle shroud of FIG. 8.
Figure 10:
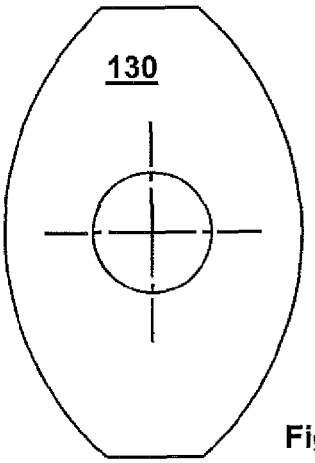
FIG. 10 shows a plan view from above of the shroud of FIGS. 8 and 9.
Figure 11:
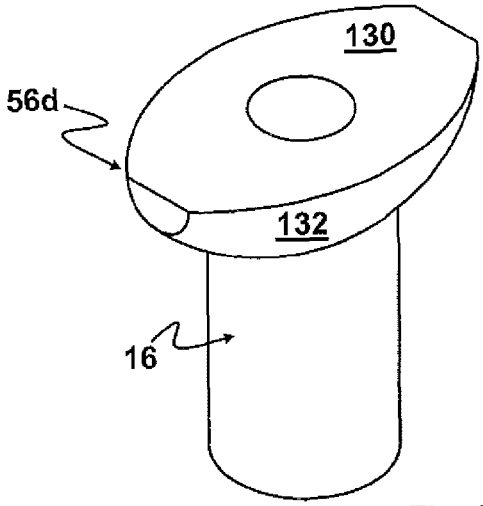
FIG. 11 shows a three-dimensional view of the shroud of FIGS. 8 to 10.

Following this fixing, the drive device 100 can function to drive the valve 14, as shown in FIGS. 6*b*, 6*c*. In order to exert a bearing force on the valve 14, fluid is injected through the channel 114, which has the effect of displacing the first piston 104 towards the right, and hence the rod 106, and hence the corresponding gate of the valve 14, as shown in FIG. 6*b*. Furthermore, by injecting fluid into the channel 116, it is possible to displace the first piston 104 in the opposite direction, towards the left, as shown in FIG. 6*c*. First piston 104 is thus configured to displace valve 14 between an open configuration and a closed configuration.

Once the manipulations on the valve 14 are finished, it is possible to release the drive device 100 from the housing 118, by proceeding as follows. The first piston 104 being in a neutral position, pressure is applied, in the direction of the arrow 128 in FIG. 6*d*, to the rear of the cylinder 102 so as to press the piston 120 against the wall 122 and thus to cause it to slide inside the chamber 112. As a result, the length of the cylinder 102 decreases and the clearance 124 reappears, which then makes it possible to withdraw the device easily from the housing 118.

It is also possible to provide a spring (elastic) washer 123 which makes it possible to prevent the locking of the piston.

It will be understood that the mode of operation described above is particularly suitable for being carried out in an automated manner. This is because it is easily possible to arrange the drive device 100 in the housing 118 by means of a robot, due to the fact that the presence of clearances 124 is allowed prior to the locking by clamping.

Furthermore, FIGS. 8 to 11 show a ladle shroud 16 having a gripping head 56*d* and a longitudinal axis 134. The gripping head has an upper surface 130 and a lower surface 132. It is easily possible to see in FIG. 11 that the lower part of the gripping head 56*d* is fusiform.

Figure 12:
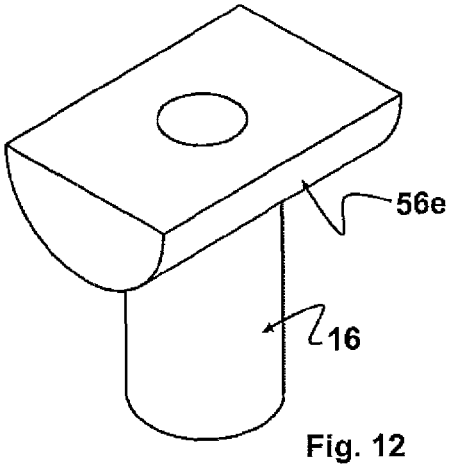
FIG. 12 shows a three-dimensional view of a ladle shroud according to another embodiment.

FIG. 12 shows another ladle shroud in which the gripping head 56*e* is semicylindrical.

Figure 13:
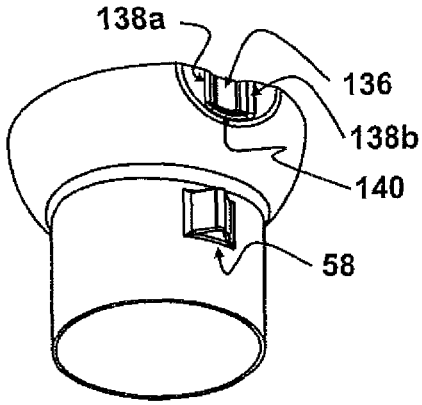
FIG. 13 shows a metal sheath intended to cover the upper end of the shroud of FIGS. 8 to 11.

FIG. 13 shows the metal sheath of the shroud of FIGS. 8 to 11. The sheath is equipped with angular orientation means, in this case wings 58 (a single one of which is visible in the drawing, the other being located on the opposite side of the shroud) and two recesses 136 which each comprise side walls 138*a*, 138*b* and a bottom wall 140 (an identical housing is arranged on the opposite side of the shroud). This recess cooperates with fingers 63 of the manipulation device

- to prevent the raising of the shroud when the lower end thereof is immersed in the bath of steel (the fingers 63 act against the bottom wall 140 of the recess 136);
- to allow the detachment of the shroud at the end of casting (the fingers 63 act against the bottom wall 140 of the recess 136); and
- to ensure that the ladle shroud is held in its support (the fingers act against the side walls 138*a*, 138*b* of the recess 136).

The advantages of the invention have been mentioned above. It will be understood that the invention is not limited to the embodiments described above.

In particular, the different functionalities may be found independently on the different manipulation and drive devices or on the shroud, or else may be combined with one another.

We claim:

1. Ladle shroud for the flow of liquid metal from a casting ladle to a metal tundish, wherein the shroud has a longitudinal axis and comprises a shroud gripping head at one end, and wherein the gripping head comprises a lower surface that is disposed circumferentially with respect to the longitudinal axis of the ladle shroud, and wherein the lower end of the gripping head has a shape selected from the group consisting of fusiform and a curved spindle.

2. Ladle shroud according to claim 1, wherein the lower end of the gripping head is fusiform.

3. Ladle shroud according to claim 1, wherein the gripping head has the shape of a curved spindle.

4. Ladle shroud according to claim 1, wherein the shroud comprises means for temporarily fixing the ladle shroud to a flow control valve.

5. Ladle shroud according to claim 4, wherein the temporary fixing is performed by a bayonet fitting.

6. Ladle shroud according to claim 4, wherein the shroud comprises an upper end and the temporary fixing means comprise means for receiving a rotary element, configured so as to be mounted to rotate on the upper end and to cooperate with the valve.

7. Ladle shroud according to claim 1, further comprising means for adjusting the angular orientation of the shroud about the vertical axis of the shroud.

8. Ladle shroud according to claim 1, further comprising releasing means configured to release the shroud from a casting orifice.

9. Ladle shroud according to claim 8, wherein the gripping head comprises side walls provided with two recesses, each recess comprising side walls and a bottom wall.

* * * * *